US005449243A

United States Patent [19]

Haab et al.

[11] Patent Number: 5,449,243

[45] Date of Patent: Sep. 12, 1995

[54] FASTENING ELEMENT FOR THE ADJUSTABLE FASTENING OF A SHEET TO A FRAME ELEMENT, AND A WALL ELEMENT

[76] Inventors: Karl Haab, Obere Weidstrasse 7, Rotkreuz, CH-6343, Switzerland; Otto Haab, Im Erspach, Mettmenstetten CH-8932, both of Switzerland

[21] Appl. No.: 115,385

[22] Filed: Sep. 1, 1993

[30] Foreign Application Priority Data

Sep. 9, 1992 [CH] Switzerland ..... 02 850/92

[51] Int. Cl.[6] ..... E05D 13/00; A47K 3/22

[52] U.S. Cl. ..... 403/409.1; 403/3; 403/387; 403/405.1; 52/800.16

[58] Field of Search ..... 403/3, 4, 387, 405.1, 403/409.1; 52/826; 49/375; 411/539, 540

[56] References Cited

U.S. PATENT DOCUMENTS

| | | | |
|---|---|---|---|
| 3,703,053 | 11/1972 | De Rees et al. | 49/375 X |
| 4,050,200 | 9/1977 | Beck | 52/826 X |
| 4,106,876 | 8/1978 | Tregoning | 403/4 |
| 4,469,352 | 9/1984 | Korner et al. . | |
| 4,653,127 | 3/1987 | Baus . | |
| 4,910,917 | 3/1990 | Brauer | 49/375 X |
| 5,141,357 | 8/1992 | Sherman et al. | 403/4 X |

FOREIGN PATENT DOCUMENTS

| | | | |
|---|---|---|---|
| 81766 | 12/1976 | Australia | 403/4 |
| 0171695 | 2/1986 | European Pat. Off. . | |
| 325736 | 8/1989 | European Pat. Off. | 403/4 |
| 837315 | 2/1939 | France | 52/826 |
| 3308812 | 9/1984 | Germany . | |
| 2045847 | 11/1980 | United Kingdom . | |
| 2098853 | 12/1982 | United Kingdom . | |
| 2182085 | 5/1987 | United Kingdom . | |

*Primary Examiner*—Anthony Knight

*Attorney, Agent, or Firm*—Cushman Darby & Cushman

[57] ABSTRACT

A fastening element for adjustably fastening a sheet to a frame is disclosed. The fastening element includes an anchor for providing the frame with studs and providing for a holder which engaging the sheet with a contact surface. The holder can be assembled with the anchor in a limited number of angular positions relative to an adjustment axis of the anchor, an inner surface of the holder engages with a peripheral surface of the anchor at each position, such that the contact surface assumes a plurality of different, non-congruent positions relative to said adjustment axis, the studs protrude beyond the holder in the direction of the adjustment axis. The invention also discloses a wall element.

12 Claims, 2 Drawing Sheets

FASTENING ELEMENT FOR THE ADJUSTABLE FASTENING OF A SHEET TO A FRAME ELEMENT, AND A WALL ELEMENT

BACKGROUND OF THE INVENTION

1. Field of the Invention

The invention relates to a fastening element for adjustable fastening of a sheet to a frame element, a wall element with a frame bar, a sheet and one or several fastening elements. Fastening elements and wall elements of these kinds are used for example for shop fronts and in furniture manufacture.

2. Description of the Related Art

In the fastening of sheets, particularly glass sheets, to frame bars, which may for example be in the form of metal sections, difficulties frequently occur because the sheets are inaccurately cut. If they are simply inserted to the full depth into a receiving groove, for example in a top frame bar, and then puttied, the side edges of adjoining sheets often do not fit one another or difficulties occur in the fitting of the sheets into a bottom frame bar.

SUMMARY OF THE INVENTION

The object of the invention is that of making it possible to fasten the sheets to a frame element in such a manner that the position of the sheet relative to the frame element is adjustable.

This object is achieved by the invention as characterized in the claims. The invention enables sheets to be fastened to the frame element and makes it possible, in the event of the position of the sheet failing to meet requirements, to release the connection, to adjust the fastening element, and to refasten the sheet. The position of the sheet can thus be corrected both in respect of the distance of the opposite edge from the frame element and in respect of the angular position of the sheet relative to the frame element.

The invention is described more fully below with the aid of drawings which illustrate only a preferred embodiment.

DESCRIPTION OF THE PREFERRED EMBODIMENTS

Figure 1:
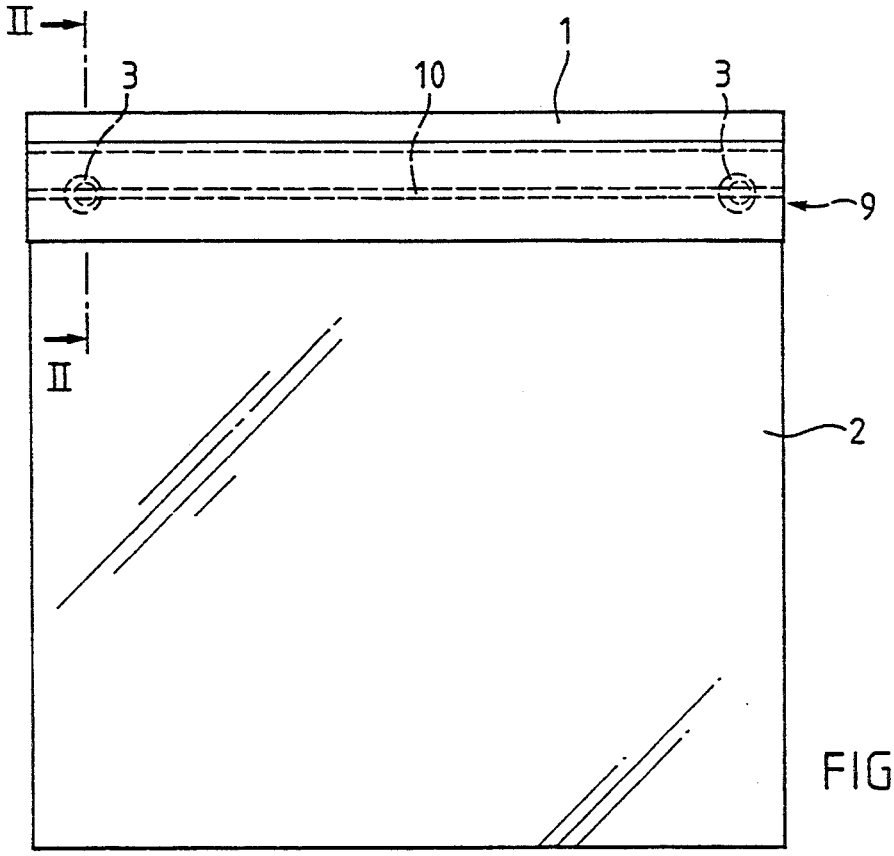
FIG. 1 is a front view of a wall element according to the invention with two fastening elements according to the invention.
Figure 2:
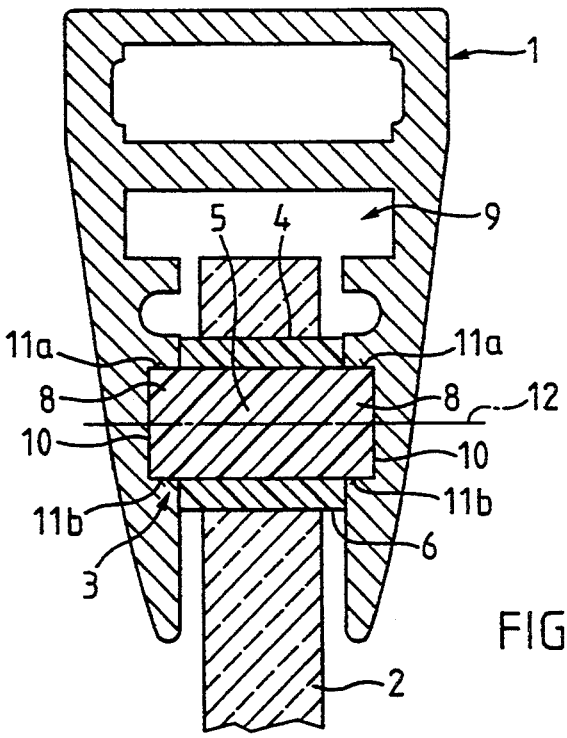
FIG. 2 is a section on the line II—II in FIG. 1, on a larger scale.

In FIG. 1 a wall element is shown—this may be an element mounted in a fixed position or else a sliding element or a door—comprising a top frame bar 1, an aluminium section, to which a glass sheet 2 is fastened. The connection between the frame bar 1 and the glass sheet 2 is made by means of two fastening elements 3 of plastics material, which are anchored on the frame bar 1 near the ends of the latter and which project through circular holes 4 in the glass sheet 2.

Each fastening element 3 consists (FIGS. 2, 3*a*, 3*b*, 4) of an anchor part 5 and a holding part 6 mounted on the latter, annularly surrounding the said anchor part 5 and provided on the outside with a contact surface 7. The said fastening element fits exactly into the hole 4, so that the edge of the latter is in unbroken contact with the contact surface 7. The anchor part 5 engages by means of anchor studs 8 in anchor grooves 10 provided at the sides in a receiving groove 9 in the frame bar 1. The anchor studs 8 are bounded at the top and bottom faces by two parallel sliding surfaces 11*a*, 11*b* which are in contact with the side surfaces of the anchor grooves 10.

Apart from the axially projecting anchor studs 8, the anchor part 5 has substantially the shape of a cylinder whose axis forms an adjustment axis 12, as will be explained in more detail later on. On its peripheral surface 13, however, it is provided with toothing comprising axially extending teeth. Neighbouring teeth are offset with an increment $\alpha$ of 10°. The holding part 6 has an inner surface 14 with complementary toothing. Its outer surface, the contact surface 7, is a cylinder lateral surface which is eccentric relative to the inner surface 14 of the holding part 6 and whose axis is an eccentric axis 15 parallel to the adjustment axis 12 and distant from it by an eccentricity $\Delta$.

Figure 3A:
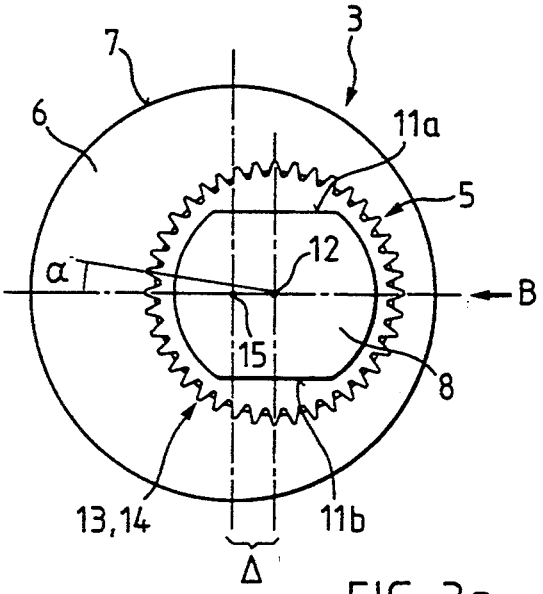
FIG. 3*a* is a side view of a fastening element according to the invention.
Figure 3B:
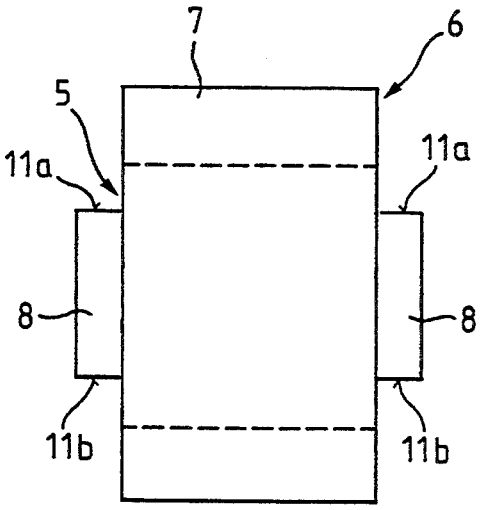
FIG. 3*b* is a further side view of the fastening element, taken in the direction of the arrow B in FIG. 3*a*.

If the glass sheet 2 is not accurately cut and, for example, widens towards the right (FIG. 1), its bottom edge will not extend parallel to the frame bar 1 but will drop towards the right when the two fastening elements 3 are adjusted as illustrated in FIGS. 3*a* and 3*b*. For correction purposes the glass sheet 2 can now be shifted to the right until the right-hand fastening element 3 is accessible and can be taken out of the hole 4.

Figure 5:
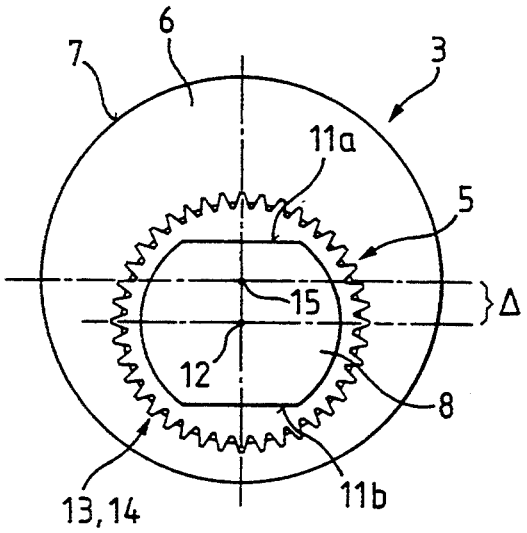
FIG. 5 is a side view of the fastening element according to FIG. 3*a*, differently adjusted.
Figure 4:
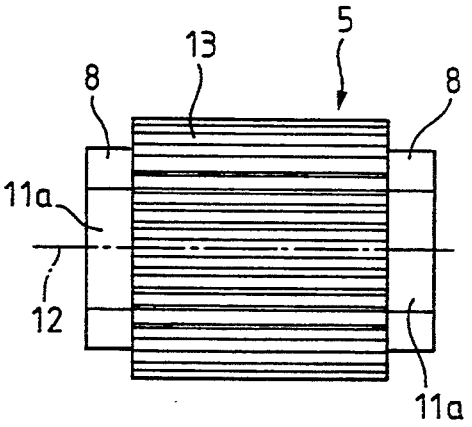
FIG. 4 is a top plan view of part of the fastening element according to FIGS. 3*a* and 3*b*.

The holding part 6 can then be pulled off the anchor part 5 and be turned to the right to the extent of any multiple of the increment $\alpha$, 90° in the extreme case which will be described below by way of example, and then replaced on the anchor part 5. The holding part 6 has thus been turned 90° to the right relative to the adjustment axis 12 (see FIG. 5) and the contact surface 7 lies, relative to the anchor part 5, higher than previously to the extent of the eccentricity $\Delta$, the distance between the adjustment axis 12 and the eccentric axis 15. If the turn were made to the left, it would lie correspondingly lower. All in all, the holding part 6 can assume 36 different angular positions relative to the adjustment axis 12, to which correspond an equal number of different positions, that is to say mutually offset positions, of the contact surface 7 relative to the adjustment axis 12, and these lead to 19 different vertical positions of the contact surface 7. Since the latter is rotationally symmetrical about the eccentric axis 15 parallel to the adjustment axis 12, the turning of the holding part 6 changes only its position, but not its shape.

The fastening part 3 can now be put back into the hole 4 in the glass sheet 2 and the latter can be pushed back towards the left, the anchor studs 8 once again engaging in the anchor grooves 10, so that the vertical position of the anchor part 5 relative to the frame bar 1 is unchanged, while the said anchor part has been shifted horizontally to the left to the extent of the eccentricity $\Delta$, although this has no effect on the position of the glass sheet 2. On the other hand, the contact surface 7 of the holding part 6 has been raised to the extent of the eccentricity $\Delta$, relative to the frame bar 1 and thus the hole 4 in the glass sheet 2 and consequently the right-hand side of the latter have also been similarly raised, so that the drop of the bottom edge has been corrected. The glass sheet 2 can now be definitively fixed in the frame bar by wedging and puttying.

We claim:

1. A fastening element for adjustably fastening a sheet to a frame element comprising anchor means for engaging the frame with studs at its opposite ends and holding means annularly surrounding the anchor means for engaging the sheet with a contact surface, which holding means can be assembled with the said anchor means in a limited number of angular positions relative to an adjustment axis of the anchor means, an inner surface of the holding means positively engaging with a peripheral surface of the anchor means at each position, such that the contact surface assumes a plurality of different, non-congruent positions relative to said adjustment axis, the studs protruding beyond the holding means in the direction of the adjustment axis, each having at top and bottom parallel sliding surfaces.

2. The fastening element of claim 1, wherein the peripheral surface of the anchor means and the inner surface of the holding means are connected together by tooth engagement.

3. The fastening element of claim 1, wherein the shape of the contact surface does not vary when the annular position of the holding means is changed.

4. A fastening element for adjustably fastening a sheet to a frame element comprising anchor means for engaging the frame with studs at its opposite ends and holding means annularly surrounding the anchor means for engaging the sheet with a cylindrical contact surface, which holding means can be assembled with the said anchor means in a limited number of angular positions relative to an adjustment axis of the anchor means, an inner surface of the holding means engaging with a peripheral surface of the anchor means at each position, the axis of the contact surface being parallel to the adjustment axis and distant therefrom by an eccentricity, the studs protruding beyond the holding means in the direction of the adjustment axis, each having at top and bottom parallel sliding surfaces.

5. The fastening element of claim 4, wherein the peripheral surface of the anchor means and the inner surface of the holding means are connected together by tooth engagement.

6. A wall element comprising a sheet having two holes in an edge region, a frame bar having a receiving groove for receiving said edge region of the sheet, the receiving groove having two mutually opposite anchor grooves, two fastening elements penetrating the holes in the sheet for adjustably fastening the same to the frame bar, each fastening element comprising anchor means for engaging the frame bar, holding means annularly surrounding the anchor means for engaging the sheet, which holding means can be assembled with the said anchor means in a limited number of angular positions relative to an adjustment axis of the anchor means perpendicular to the sheet, an inner surface of the holding means positively engaging with a peripheral surface of the anchor means at each position, such that a contact surface contacting the edge of the hole in the sheet assumes a plurality of different, non-congruent positions relative to said adjustment axis, the anchor means comprising studs protruding beyond the holding means in the direction of the adjustment axis and into the anchor grooves, each having at top and bottom parallel sliding surfaces for non-rotatable and slidable engagement with said anchor grooves.

7. The fastening element of claim 6, wherein the peripheral surface of the anchor means and the inner surface of the holding means are connected together by tooth engagement.

8. The fastening element of claim 6, wherein the shape of the contact surface does not vary when the angular position of the holding means is changed.

9. The wall element of claim 8, wherein the edge of each hole is in unbroken contact with the respective contact surface.

10. A wall element comprising a sheet having two holes in an edge region, a frame bar having a receiving groove for receiving said edge region of the sheet, the receiving groove having two mutually opposite anchor grooves, two fastening elements penetrating the holes in the sheet for adjustably fastening the same to the frame bar, each fastening element comprising anchor means for engaging the frame bar, holding means annularly surrounding the anchor means for engaging the sheet, which holding means can be assembled with the said anchor means in a limited number of angular positions relative to an adjustment axis of the anchor means perpendicular to the sheet, an inner surface of the holding means positively engaging with a peripheral surface of the anchor means at each position, such that a cylindrical contact surface contacting the edge of the hole in the sheet assumes a plurality of different, non-congruent positions relative to said adjustment axis, the axis of the contact surface being parallel to the adjustment axis and distant therefrom by an eccentricity, the anchor means comprising studs protruding beyond the holding means in the direction of the adjustment axis and into the anchor grooves, each having at top and bottom parallel sliding surfaces for non-rotatable and slidable engagement with said anchor grooves.

11. The fastening element of claim 10, wherein the peripheral surface of the anchor means and the inner surface of the holding means are connected together by tooth engagement.

12. The wall element of claim 10, wherein the edge of each hole is in unbroken contact with the respective contact surface.

* * * * *

UNITED STATES PATENT AND TRADEMARK OFFICE
CERTIFICATE OF CORRECTION

PATENT NO. : 5,449,243

DATED : September 12, 1995

INVENTOR(S) : HAAB et al.

It is certified that error appears in the above-identified patent and that said Letters Patent is hereby corrected as shown below:

Column 4, line 19 (claim 7), change "fastening" to --wall--;

line 23 (claim 8), change "fastening" to --wall--;

line 59 (claim 11), change "fastening" to --wall--.

Signed and Sealed this

Eighteenth Day of June, 1996

*Attest:*

BRUCE LEHMAN

*Attesting Officer*

*Commissioner of Patents and Trademarks*